United States Patent [19]

Power

[11] 4,050,382

[45] Sept. 27, 1977

[54] ELECTRICALLY DETONATED EXPLOSIVE DEVICE

[75] Inventor: John M. Power, Hull, Canada

[73] Assignee: Her Majesty the Queen in right of Canada, as represented by the Minister of National Defence, Canada

[21] Appl. No.: 707,658

[22] Filed: July 22, 1976

[30] Foreign Application Priority Data

Aug. 18, 1975 Canada ..... 233671

[51] Int. Cl.[2] ..... F42C 3/00

[52] U.S. Cl. ..... 102/16; 102/70.2 R

[58] Field of Search ..... 102/19.2, 16, 7, 70.2 R; 200/61.04

[56] References Cited

U.S. PATENT DOCUMENTS

| | | | |
|---|---|---|---|
| 2,459,267 | 1/1949 | Dwyer et al. | 102/16 |
| 2,945,441 | 7/1960 | Winslow | 102/16 |
| 3,064,576 | 11/1962 | Lytle | 102/19.2 |
| 3,199,453 | 8/1965 | Fasig et al. | 102/7 |

*Primary Examiner*—Charles T. Jordan

*Attorney, Agent, or Firm*—A. W. Breiner

[57] ABSTRACT

A safety circuit for a marine signal device adapted to be fired after being dropped into sea water. The device has a casing which will allow the water to enter when ready for firing. A salt water battery, a water pressure operated switch and an electric blasting cap are all connected in series within the casing. A resistor of selected value is connected across the terminals of the battery so that the battery will be discharged in a predetermined time if the blasting cap fails to be detonated by the action of water pressure on the switch at a predetermined depth. Furthermore, a shunt is provided between the leads of the blasting cap to reduce the hazards during handling due to static charges or radio frequencies. The shunt may be manually removed prior to firing or in one embodiment the pressure operated switch automatically disconnects the shunt when the switch is operated by water pressure.

3 Claims, 4 Drawing Figures

ELECTRICALLY DETONATED EXPLOSIVE DEVICE

This invention relates to safety circuits for electrically detonated signalling devices and more particularly to safety circuits for devices to be detonated in water.

Known signalling devices of the type on which the safety circuit is to be used generally include a salt water activated battery, a pressure operated switch and an electric blasting cap wired in series. Activation of the device requires immersion of the battery in salt water and closure of the switch when the desired depth is reached at which time the blasting cap is detonated.

It has been found that there are two areas in which the safety of such electrically detonated devices can be improved. Firstly reducing the possibility that a static charge or induced current such as a radio frequency will cause premature detonation of the electric blasting cap during assembly or storage of the device.

Secondly, there is the danger that the device on being immersed in salt water will lodge on some underwater obstruction after wetting of the battery but at less than operating depth thereby posing a serious threat to a diver attempting to remove the device. In this case the pressure switch would be open and the battery would retain its charge for a week or more.

Furthermore should the device fail to detonate at its operating depth it would sink to the bottom where it might become fouled in fishing nets. Should the fisherman try to dispose of the device it would be very dangerous if the salt water battery has retained a charge sufficient to detonate the blasting cap.

A still further danger is that of the signaling devices being accidentally dropped into shallow water, thus wetting the battery at a depth insufficient to close the contacts of the pressure switch so as to detonate the device.

It is therefore an object of the present invention to provide a circuit for the electrically detonated signal device which will reduce the hazards from static charges during handling as well as radio frequencies but which will be removed automatically immediately prior to detonation.

A further object of the invention is the provision of a circuit which will cause the battery to be discharged a short time after firing should have occurred if for any reason the device fails to detonate.

Accordingly, the present invention provides an electrical circuit for use in detonating an explosive device under water the circuit comprising, a battery, a water pressure operated switch, an electric blasting cap wired in series with the switch and the battery and a resistor of selected value connected across terminals of the battery whereby decay of the battery takes place as soon as the battery is activated by salt water so that if the explosive device fails to detonate at its operating depth, on closing of contracts of said pressure switch, the battery will have less than a minimum voltage required to detonate the device within a selected time period after firing should have taken place.

The invention further provides an electrical circuit for use in detonating an explosive device underwater, the circuit comprising a battery, a water pressure operating switch, an electric blasting cap wired in series with the switch and the blasting cap and a shunt connected accross a pair of leads of the blasting cap where the shunt prevents build up of static electricity during handling or storage prior to removal of the shunt from the circuit when the device is to be detonated.

In the accompanying drawings which illustrate embodiments of the circuit;

Figure 1:
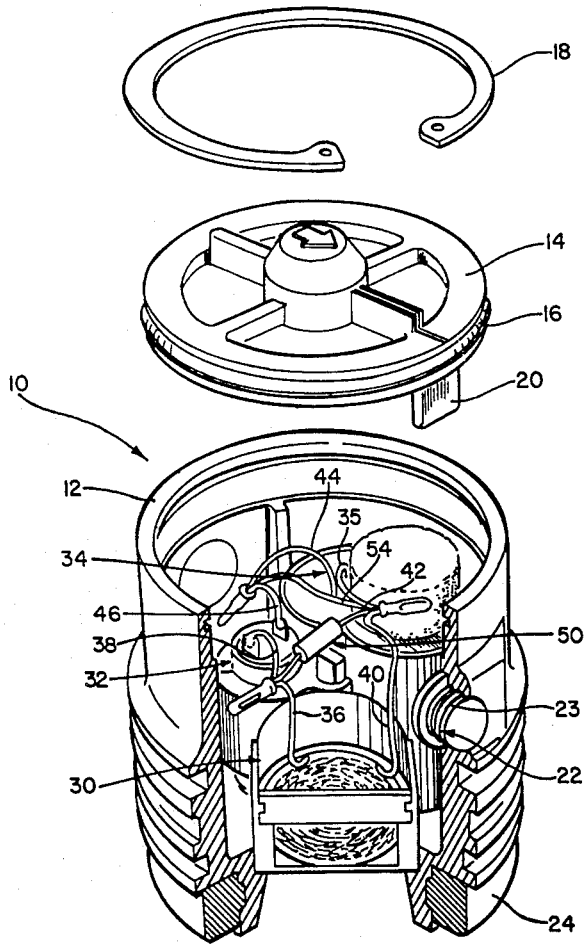
FIG. 1 is an exploded perspective view, partly in section, of an electrically detonated marine signaling device including the safety circuit of this invention.

Referring now in detail to the drawings in which an electrically detonated marine signalling device shown generally at 10 in FIG. 1 is provided with a watertight casing 12. The casing 12 has a closed lower end and an open upper end, adapted to be closed by a cover 14 which has a suitable "O" ring 16 and a retaining ring 18 to provide a watertight seal. It should be noted that a depending lug 20 on the cover 14 extends over a port plug 22 received in an opening in the side wall of the casing. The cover can be turned to allow the port plug 22 with O ring 23 to be pushed inwardly for reasons to be explained below. If necessary the casing may also be provided with a lead weight 24.

In the interior of the casing 12 are the elements of the electrically detonated signal including a salt water activated battery 30, a water pressure operated switch 32 and an electric blasting cap 34. In the embodiment shown in FIGS. 1 and 3 one lead 36 of the salt water battery is connected to a lead 38 of the pressure switch, the other lead 40 of the battery 30 is connected to a lead 42 of the electric blasting cap. The other lead 44 of the electric blasting cap is in turn connected to a second lead 46 on the pressure switch 32 so that the battery, switch and blasting cap are in series.

Figure 2:
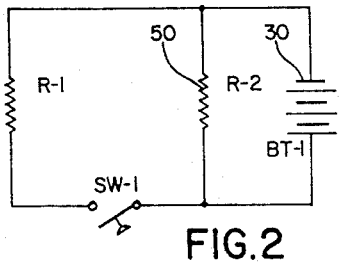
FIG. 2 is a diagramatic view of a simplified form of the safety circuit.

In FIG. 2 a simplified form of the safety circuit is shown in which a resistor 50 is shown connected across the leads 36 and 40 of the battery 30. (See also FIG. 1)

The presence of the resistor 50 in the circuit causes decay of the battery voltage commencing with activation of the battery upon immersion in salt water. It is a well known fact that the higher the value of the resistor the slower the decay process. The selection of the optimum resistor value is predicated by (a) the time required for the device to fall through the water so as to reach operating depth plus a safety factor and (b) the maximum time which is acceptable for the battery voltage to decay below the minimum firing voltage.

It has been found that a suitable resistor for the purpose of discharging the battery is about 10 ohms.

The battery 30 is of the type comprising magnesium and silver strips separated by a perforated plastic sheet and will obtain a charge in approximately one second when immersed in salt water.

Figure 3:
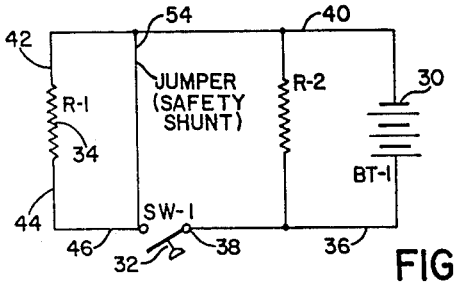
FIG. 3 is a diagramatic view of the electrical circuit of the signalling device of FIG. 1

In the circuit shown in FIGS. 1 and 3, a shunt or jumper 54 is connected across the leads 42 and 44 of the electric blasting cap. This safety shunt reduces the hazard of accidental detonation of the device 10 during handling or storage due to static electricity or radio frequencies. The shunt 54 is removed immediately prior to closing the signal device at manufacture.

Figure 4:
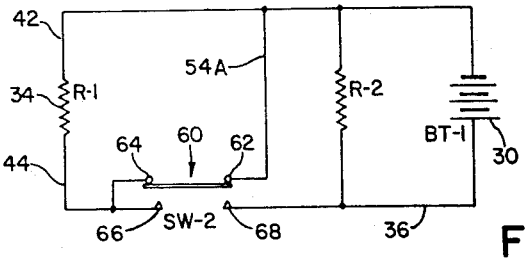
FIG. 4 is a diagramatic view of a modified form of the circuit of FIG. 3 including a four contact pressure switch.

In FIG. 4 a further modification of the safety circuit is shown in which a four contact pressure switch 60 replaces the switch 32 of FIG. 3. The shunt 54A is thus connected from the lead 42 of the blasting cap 34 to a contact 62 of the switch 60. A second contact 64 is connected to the lead 44 on the electric blasting cap 34. In this manner the shunt 54A is placed in the circuit when the contacts 62 and 64 of the switch 60 are closed. A further pair of contacts 66 and 68 will be closed when the switch is operated due to water pressure at a selected depth and the lead 36 from the battery 30 will be connected to the blasting cap through the switch and lead 44. In this position of the switch the shunt will be out of the circuit and the explosive device will be armed.

In operation assuming the device has been filled with explosives or a signal flare and that all electrical connections have been properly made the cover is secured on the casing and the port plug 22 is retained in place by the lug 20. The signal 10 is then ready to be armed and fired.

Immediately before dropping the signal device from a ship, plane or helicopter into the water it is armed by turning the cover 14 so that the lug 20 no longer covers the port plug 22 and thus the plug 22 may be pushed in so that the port will be open to allow sea water to enter the casing 12.

When the casing 12 is immersed in water the battery 30 will immediately begin gaining a charge and when the predetermined depth is reached water pressure will cause the contacts of switch 30 to close thus detonating the electric blasting cap which in turn detonates an explosive charge, a flare or smoke candle 35. In the case of switch 60 shown in FIG. 4 a connection is made between contacts 66 and 68 thereby disconnecting the shunt 54A and connecting the battery 30 to the blasting cap 34.

Should the signal device 10 fail to fire for any reason, such a failure of the pressure switch to operate, the battery 30 will be drained in seconds by the resistor 50.

The embodiments of the invention in which an exclusive property or privilege is claimed are defined as follows:

1. An electrical circuit for use in detonating an explosive device under water said circuit comprising a battery, a water pressure operated switch, an electric blasting cap wired in series with said switch and said battery and a resistor of selected value connected across terminals of said battery whereby decay of said battery takes place as soon as said battery is activated by salt water so that if said explosive device fails to detonate at its operating depth, on closing of contacts of said pressure switch, said battery will have less than a minimum voltage required to detonate the device within a selected time period after the firing should have taken place.

2. An electrical circuit for use in detonating an explosive device underwater said circuit comprising; a battery, a water pressure operated switch, an electric blasting cap wired in series with said switch and said blasting cap and a shunt connected across a pair of leads of said blasting cap whereby said shunt prevents build up of static electricity during handling prior to removal of said shunt from the circuit when the device is to be sealed.

3. An electrical circuit as claimed in claim 2 wherein said pressure operated switch, in firing position, removes said shunt from said circuit.

* * * * *